US006257922B1

(12) United States Patent
Shinozaki

(10) Patent No.: US 6,257,922 B1
(45) Date of Patent: Jul. 10, 2001

(54) CONNECTOR

(75) Inventor: Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/189,394

(22) Filed: Nov. 10, 1998

(30) Foreign Application Priority Data

Nov. 12, 1997 (JP) ..... 9-310751

(51) Int. Cl.[7] ..... H01R 3/00
(52) U.S. Cl. ..... 439/489; 439/188
(58) Field of Search ..... 439/489, 188, 439/352, 490, 66

(56) References Cited

U.S. PATENT DOCUMENTS

| | | | | |
|---|---|---|---|---|
| 4,900,267 | | 2/1990 | Nagasaka et al. | 439/489 |
| 5,145,356 | * | 9/1992 | Minnis | 439/189 |
| 5,562,486 | | 10/1996 | Saijo et al. | 439/489 |
| 5,613,872 | | 3/1997 | Fukuda et al. | 439/489 |
| 5,647,762 | | 7/1997 | Fukuda | 439/489 |
| 5,651,693 | | 7/1997 | Fukuda et al. | 439/489 |
| 5,709,563 | * | 1/1998 | Saito | 439/275 |
| 5,743,760 | * | 4/1998 | Inaba et al. | 439/489 |
| 5,863,216 | * | 1/1999 | Tsuji | 439/489 |
| 5,997,344 | * | 12/1999 | Shinozaki | 439/489 |

FOREIGN PATENT DOCUMENTS

| | | |
|---|---|---|
| 624 925 | 11/1994 | (EP) . |
| 2 305 554 | 4/1997 | (GB) . |

* cited by examiner

*Primary Examiner*—Brian Sircus
*Assistant Examiner*—Son V. Nguyen
(74) *Attorney, Agent, or Firm*—Banner & Witcoff, Ltd.

(57) ABSTRACT

A protective wall (42), formed in a unified manner, rises to a specified height from the posterior end of a base face (41) of a detecting chamber (40). A short-circuiting terminal (50) is inserted into the detecting chamber (40) from the anterior, a base member (51) thereof striking against the protective wall (42), thus fixing and maintaining the position of the base member (51). A retainer (60), retains the short-circuiting terminal (50) in a specified position and in an unremovable state. Foreign objects attempting to enter the detecting chamber (40) from the posterior will strike against the protective wall (42). The protective wall (42) via a sealing cover (43), also regulates the travel of the locking arm (30) and thus the terminal (50).

12 Claims, 7 Drawing Sheets

CONNECTOR

TECHNICAL FIELD

The present invention relates to a connector provided with an electrical fitting detecting function.

BACKGROUND TO THE INVENTION

Conventional connectors provided with a fitting detecting function include the one described in JP 7-201414. In this kind of connector, as shown in FIG. 7 of this specification, a resiliently movable locking arm 2 is provided on a female housing 1, this locking arm 2 being engaged by a latching member 6 of a corresponding male housing 5. A terminal housing chamber 3 is formed within the female housing 1, this terminal housing chamber 3 being open in a posterior direction and housing a disconnecting terminal 4 capable of making contact with a detecting terminal 7 provided on the male housing 5. When the female housing 1 is fitted to the male housing 5, the locking arm 2 is pushed in and moves in a downwards direction and the disconnecting terminal 4 moves therewith in a downwards direction. If the housings 1 and 5 remain in a half-fitted state, the disconnecting terminal 4 is unable to make contact with the detecting terminal 7. If the housings 1 and 5 are correctly fitted together, the disconnecting terminal 4 returns upwards to its original position together with the locking arm 2 and makes contact with the detecting terminal 7. As a result, it can be detected that the housings 1 and 5 are correctly fitted together.

In the case of conventional connectors, the terminal housing chamber 3 is open in a posterior direction to permit easy installation of the disconnecting terminal 4, etc. Consequently, there is a possibility that foreign objects enter from this posterior opening and collide against the disconnecting terminal 4 and that, in an extreme case, the disconnecting terminal 4 change shape beyond its limit of resilience. Under these conditions there was little room for improvement.

The present invention has been developed in response to the circumstances described above, and aims to prevent the disconnecting terminal from becoming accidentally or deliberately deformed, by preventing foreign objects from entering the terminal housing chamber.

SUMMARY OF THE INVENTION

According to the invention there is provided an electrical connector comprising two mutually engageable connector housings, one of said housings having a chamber containing a resilient short-circuit terminal, and the other of said housings having a detecting terminal engageable with said short-circuit terminal, said one housing further including a latch arm resiliently movable from an engaged to a disengaged condition, and being engageable with a latch member of said other housing, said latch arm and short-circuit terminal being adjacent and movable together such that said short-circuit terminal and detecting terminal are engaged only when said latch arm and latch member are engaged, wherein said chamber has a front opening facing towards said other housing, and said short-circuit terminal is insertable through said front opening.

Such an arrangement ensures that, once connected, the installation opening for the short-circuit terminal is covered by the corresponding connector. Thus there is no possibility that an object can enter through this opening to disturb the position of the short-circuit terminal.

The chamber may include a rear opening covered by a membrane, and said rear opening may be in a direction lateral to the engagement axis of the connector. In this way a latch arm of the connector may indirectly operate the short-circuit terminal via the membrane.

In the preferred embodiment a latch arm engages the body of the connector when moved through a desired operating range, this engagement both regulating the amount of latch arm movement directly, and the amount of movement of the short-circuit terminal indirectly. Preferably the latch arm strikes against a protective wall which closes a rear opening of said chamber. A retainer may be provided to latch the short-circuit terminal with respect to the respective connector housing.

BRIEF DESCRIPTION OF DRAWINGS

Other features of the invention will be apparent from the following description of a preferred embodiment shown by way of example only in the accompanying drawings, in which.

DESCRIPTION OF PREFERRED EMBODIMENT

Figure 1:
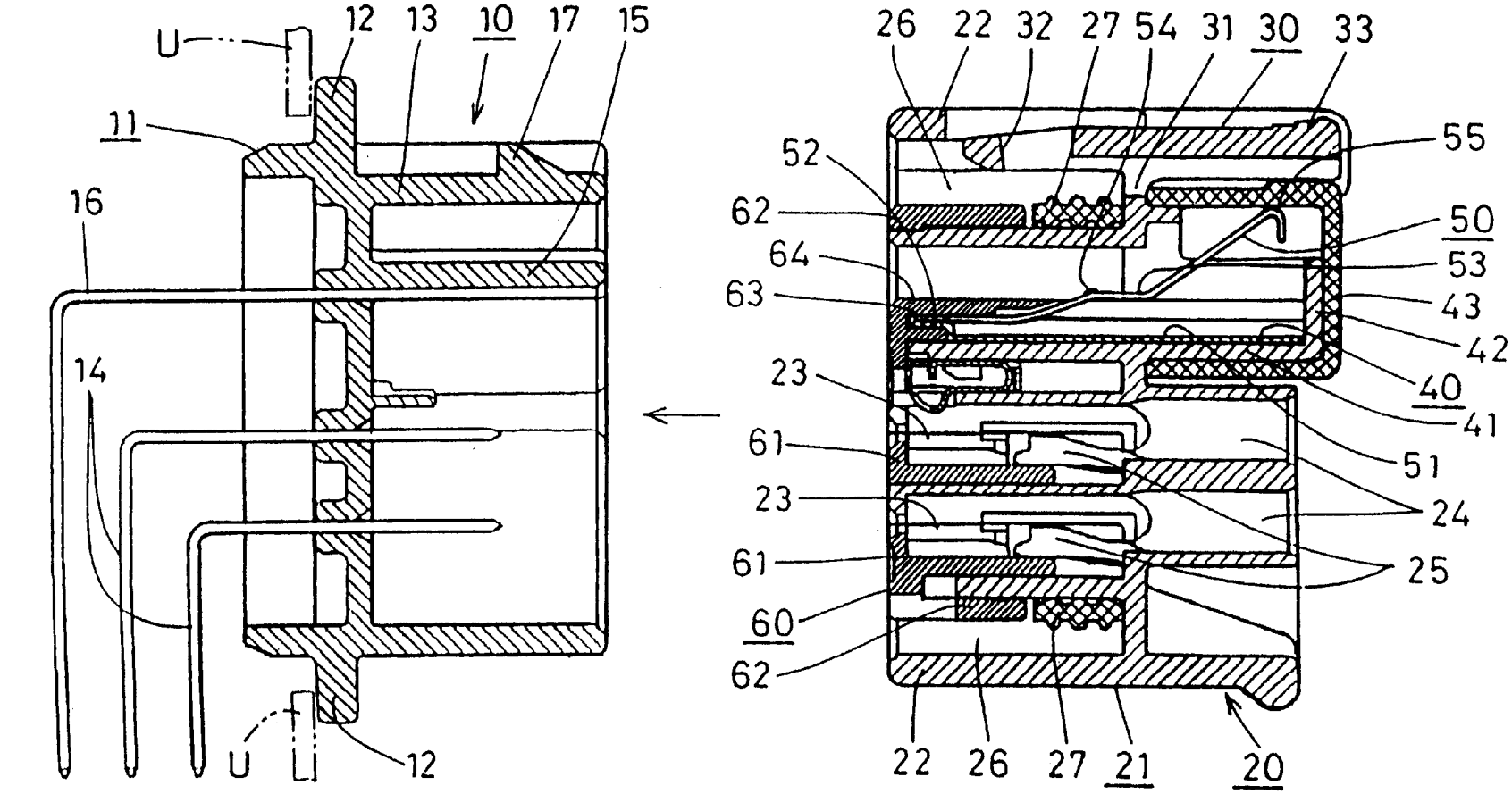
FIG. 1 is a cross-sectional view of an embodiment of the present invention showing connectors in a state prior to being fitted together.

An embodiment of the present invention is described below with the aid of FIGS. 1 to 6. This embodiment illustrates a connector attached for a computer unit of an automobile. A shown in FIG. 1, this connector comprises a male connector 10, on the left, and a female connector 20, on the right. The fitting faces of the connectors 10 and 20 will be referred to below as being located on the anterior side.

First the male connector 10 will be explained. The male connector 10 is provided with a male housing 11 made from synthetic resin, installation flanges 12 protruding from the exterior face thereof, these capable of being installed on a computer unit U by a clamp or other such means. Angular tubular members 13, which fit within fitting spaces 26 of a female housing 21 (to be described later), are formed within the male housing 11, and a plurality of male terminal fittings 14 are provided in the male housing 11. One end of each male terminal fitting 14 protrudes from the rear face of the male housing 11 and is bent downwards, the anterior ends thereof being connected to a circuit board (not shown) and the other ends protruding so as to be parallel to the angular tubular members 13.

On the upper side of the interior of the male housing 11, a protecting member 15 protrudes horizontally from the rear face wall to the opening wall. A pair of detecting terminals 16 (on the closer and farther sides in FIG. 1) are provided in a parallel manner and at a specified distance on the lower face of the protecting member 15, each detecting terminal 16, like the male terminal fittings 14, leading out to the exterior of the male housing 11 and being connected to the circuit board. Fitting protrusions 17 are formed at a specified position on the upper face of the angular tubular members 13 located above the protecting member 15, these fitting protrusions 17 fitting with a locking arm 30 provided on the female housing 21.

Next the female connector 20 will be explained, this female connector 20 being provided with a female housing 21 also made from synthetic resin, the outer circumference wall thereof forming an angular-tubular hood member 22 into which fits the male housing 11. Terminal housing members 23 and a detecting chamber 40 (to be described later) are formed within the hood member 22. A plurality of cavities 24 which correspond to the male terminal fittings 14 are formed within the terminal housing members 23, a female terminal fitting (not shown) provided with a rubber stopper being inserted into each cavity 24 from the posterior direction, and each female terminal fitting being housed in an unremovable state by a lance 25. A ring-like fitting space 26 is formed in the space between the hood member 22 and the area surrounding the terminal housing members 23, the angular tubular members 13 of the male housing 11 entering this fitting space 26, and the interior portion of the fitting spaces 26 being provided with a sealing ring 27.

The locking arm 30 is provided on the upper face of the female housing 21, this locking arm 30 facing in an anterior-posterior direction and being movable in a see-saw fashion with a supporting member 31 as its centre. The anterior end of the supporting member 31 opens out into a locking hole 32, this locking hole 32 fitting with the fitting protrusions 17 of the male housing 11, and the posterior end thereof forming an operating edge 33.

The detecting chamber 40 has a front opening 44 and is formed at the central portion in a width-wise direction at a location above the terminal housing members 23, this detecting chamber 40 housing a short-circuiting terminal 50. The detecting chamber 40 has a schematically angular-tubular shape and passes through the female housing 21 from the anterior to the posterior. A protective wall 42, formed in a unified manner, rises upwards from the posterior end of a base face 41 of the detecting chamber 40 to a position slightly above the mid-height of the detecting chamber 40. The upper face of the posterior end of the detecting chamber 40 and the upper ends of the protective wall 42 on the left and right side faces are cut away so as to form a side opening 45, to allow the operating edge 33 side of the locking arm 30 to move. Further, the posterior face of the detecting chamber 40 is covered by an elastomeric sealing cover 43. The upper face of the posterior end of the sealing cover 43 is attached with adhesive to the lower face of the operating edge 33 of the locking arm 30.

Figure 3:
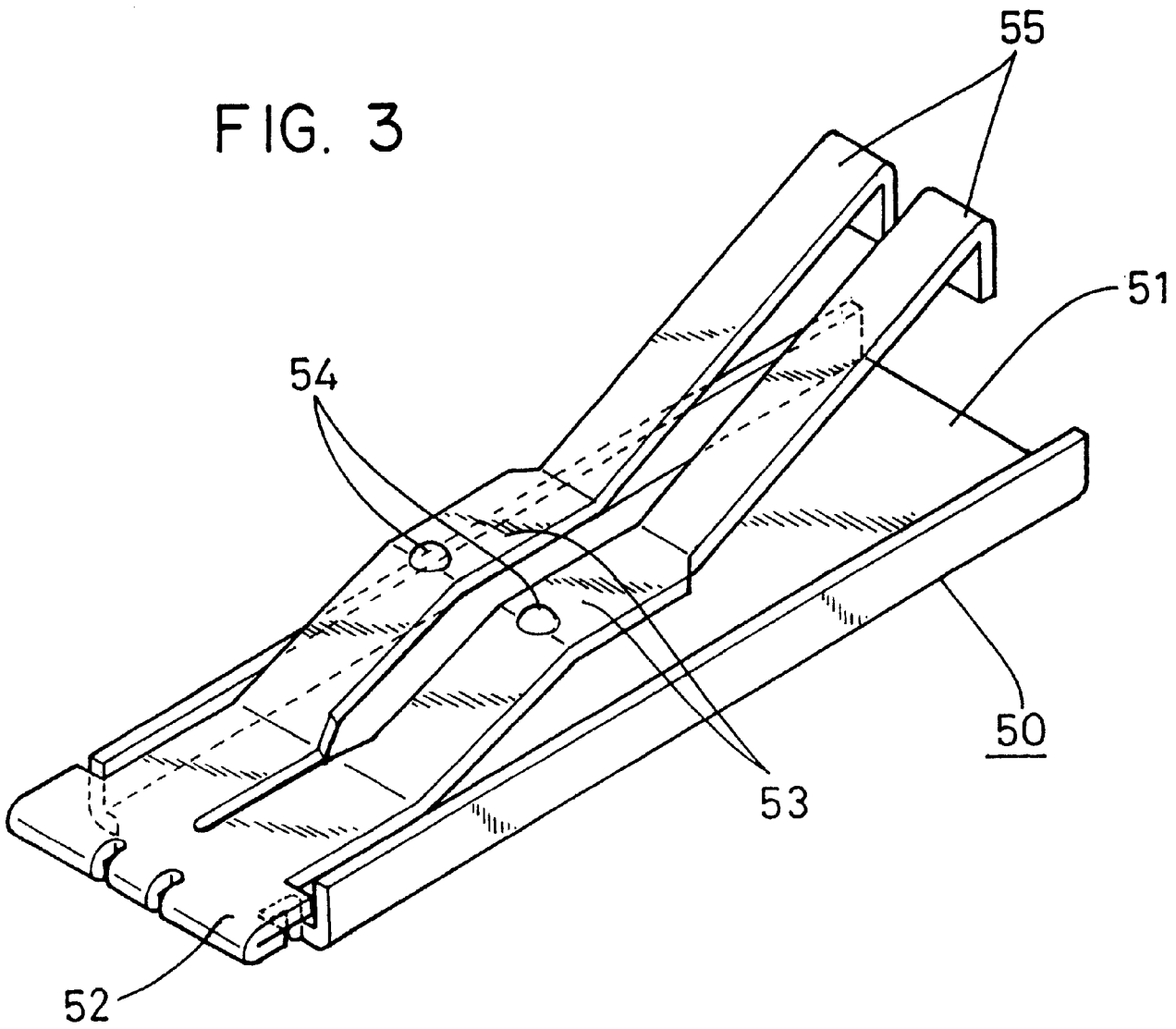
FIG. 3 is a diagonal view of a short-circuiting terminal.

The short-circuiting terminal 50 housed within the detecting chamber 40 is configured as shown in FIG. 3. That is, a long and thin base member 51 is provided in an anterior-posterior direction, this being split from its anterior end into two sections, these sections being folded back to form a folded member 52, thereby forming a pair of bending members 53 having spring-like qualities. Each bending member 53 is divided into two stages, these being bent diagonally upwards, connecting members 54 being formed by pressing-in where the lower inclined section joins the horizontal section above it. Furthermore, the tip of each being member 53 forms pressure receiving members 55. As described in detail further on, the base member 51 of the short-circuiting terminal 50 is inserted from the anterior side along the base face 41 of the detecting chamber 40, this insertion being halted when the base member 51 strikes against the protective wall 42. When the short-circuiting terminal 50 is in an inserted state, the pressure receiving members 55 of each bending member 53 make contact with the ceiling face of the sealing cover 43, and the connecting members 54 are formed so as to attain a height whereby they come in contact with the detecting terminals 16 of the male connector 11 (see FIG. 1).

A retainer 60 is attached to the anterior face of the female housing 21. Bending regulation members 61 protrude from the retainer 60 into the bending spaces of the lances 25, these bending regulation members 61 regulating the bending of the lances 25 and strengthening the removal prevention of the female terminal fittings. In addition, pressure members 62 protrude towards the anterior side of the sealing ring 27, these preventing the sealing rings 27 from also being pulled out when the male housing 11 is pulled out from the female housing 21. Further, an insertion groove 63 of the retainer 60 supports the upper face of the base end of the bending member 53 of the short-circuiting terminal 50, the folded member 52 also being inserted therein. Moreover, a hole 64 allows the protecting member 15 and the detecting terminals 16 of the male housing 11 to pass therethrough.

The present embodiment is configured as described above; next, the operation of the present embodiment is explained.

Figure 2:
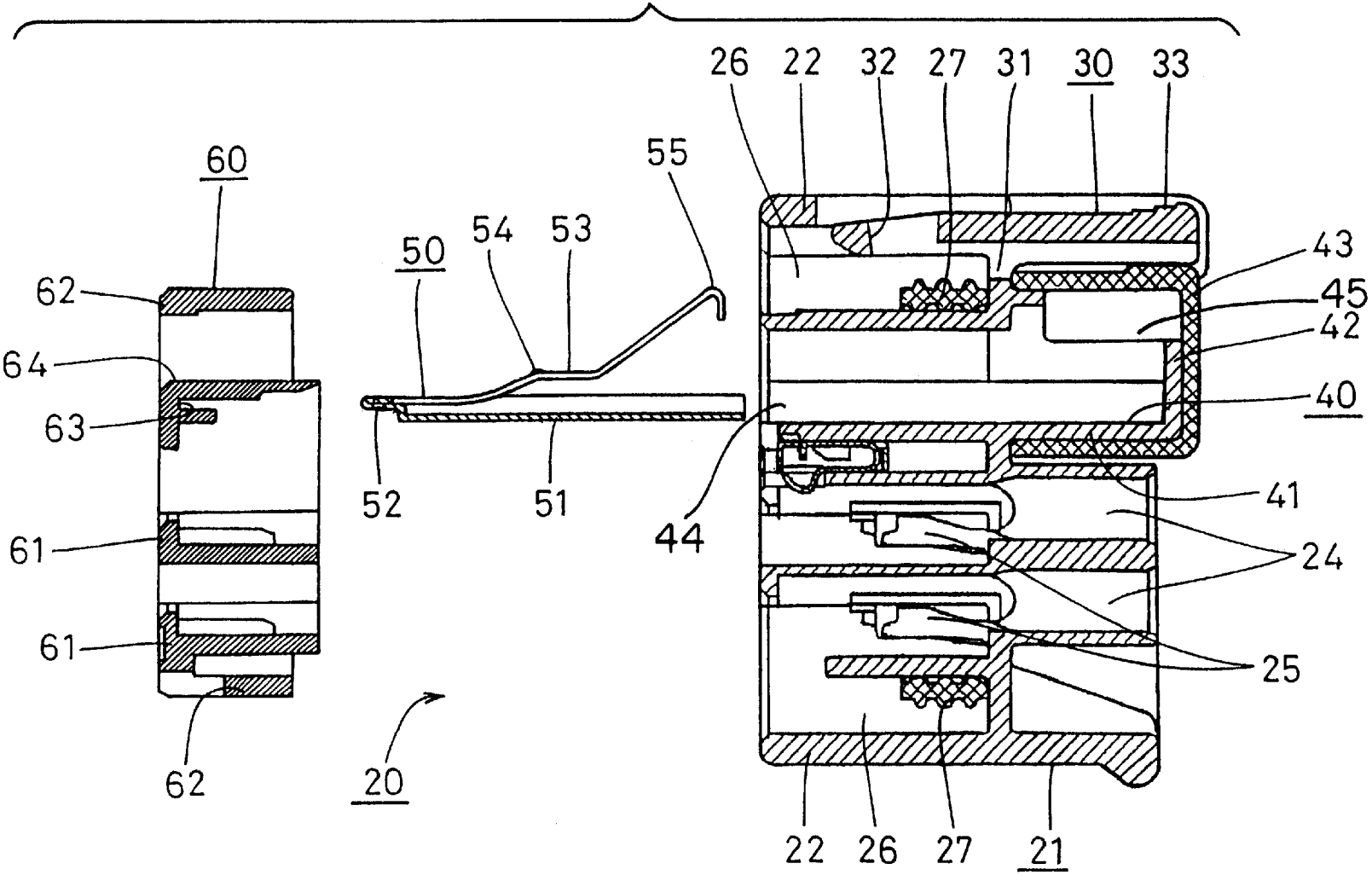
FIG. 2 is a disassembled cross-sectional view of a female connector.

First, from the state shown in FIG. 2, the short-circuiting terminal 50 is inserted into the detecting chamber 40 from the opening 44 on the anterior side. When this is done, the pressure receiving members 55 are pressed, causing the short-circuiting terminal 50 to resiliently change shape and become flatter. Simultaneously, the base member 51 is pushed in along the base face 41 of the detecting chamber 40. When the posterior end (the right end in FIG. 2) of the base member 51 strikes against the protective wall 42, the insertion ends and the position of the base member 51 is maintained. Along with the short-circuiting terminal 50, the female terminal fittings are also inserted into each cavity 24 from the posterior side.

Next, the retainer 60 is attached to the anterior face of the female housing 21 and is locked thereto by a locking member (not shown) such as a resilient latch. While the retainer 60 is being attached, the folded member 52 of the short-circuiting terminal 50 is inserted into the insertion groove 63 of the retainer 60, and the short-circuiting terminal 50 is maintained in an anterior-posterior direction and in an unremovable state within the detecting chamber 40.

Figure 4:
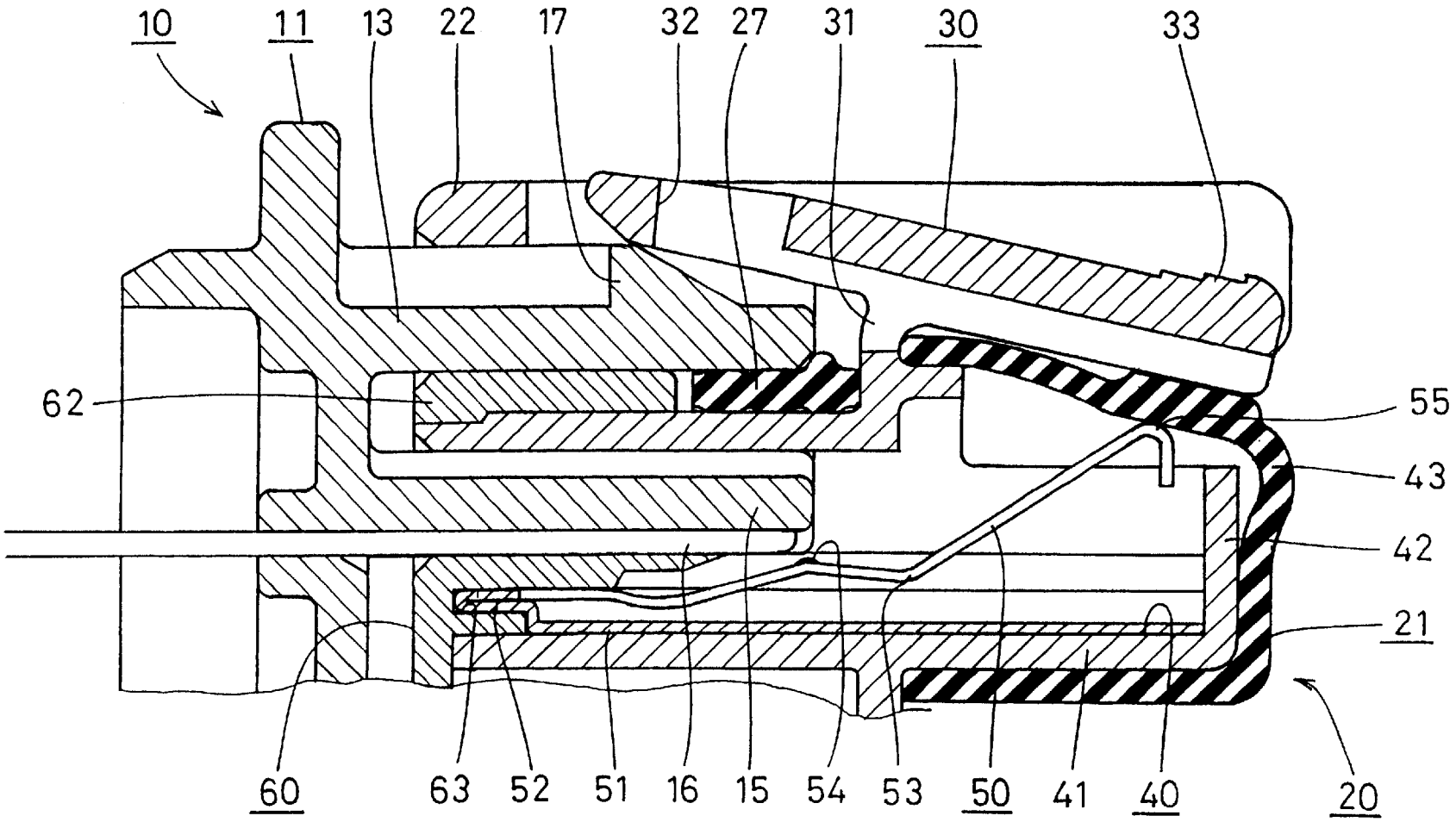
FIG. 4 is a partial cross-sectional view showing the connectors being fitted together.

Next, the female connector 20, assembled as described above, is fitted to a corresponding male connector 10, as shown by the arrow in FIG. 1. While this fitting takes place, as shown in FIG. 4, the fitting protrusions 17 provided on the male housing 11 strike against the anterior end of the locking arm 30, this anterior end portion being pressed upwards and the locking arm 30 moving in a clockwise direction. At this juncture, a specified length of the protecting member 15 and the detecting terminals 16 is inserted from the anterior side into the detecting chamber 40, the operating edge 33 side of the locking arm 30 moves in a downwards direction, the sealing cover 43 assumes a concave shape and presses the pressure receiving members 55 of the short-circuiting terminal 50, this pressing down on the bending member 53. Together with this the connecting members 54 are also moved in a downwards direction, and consequently the connecting members 54 do not make contact with the detecting terminals 16.

Figure 5:
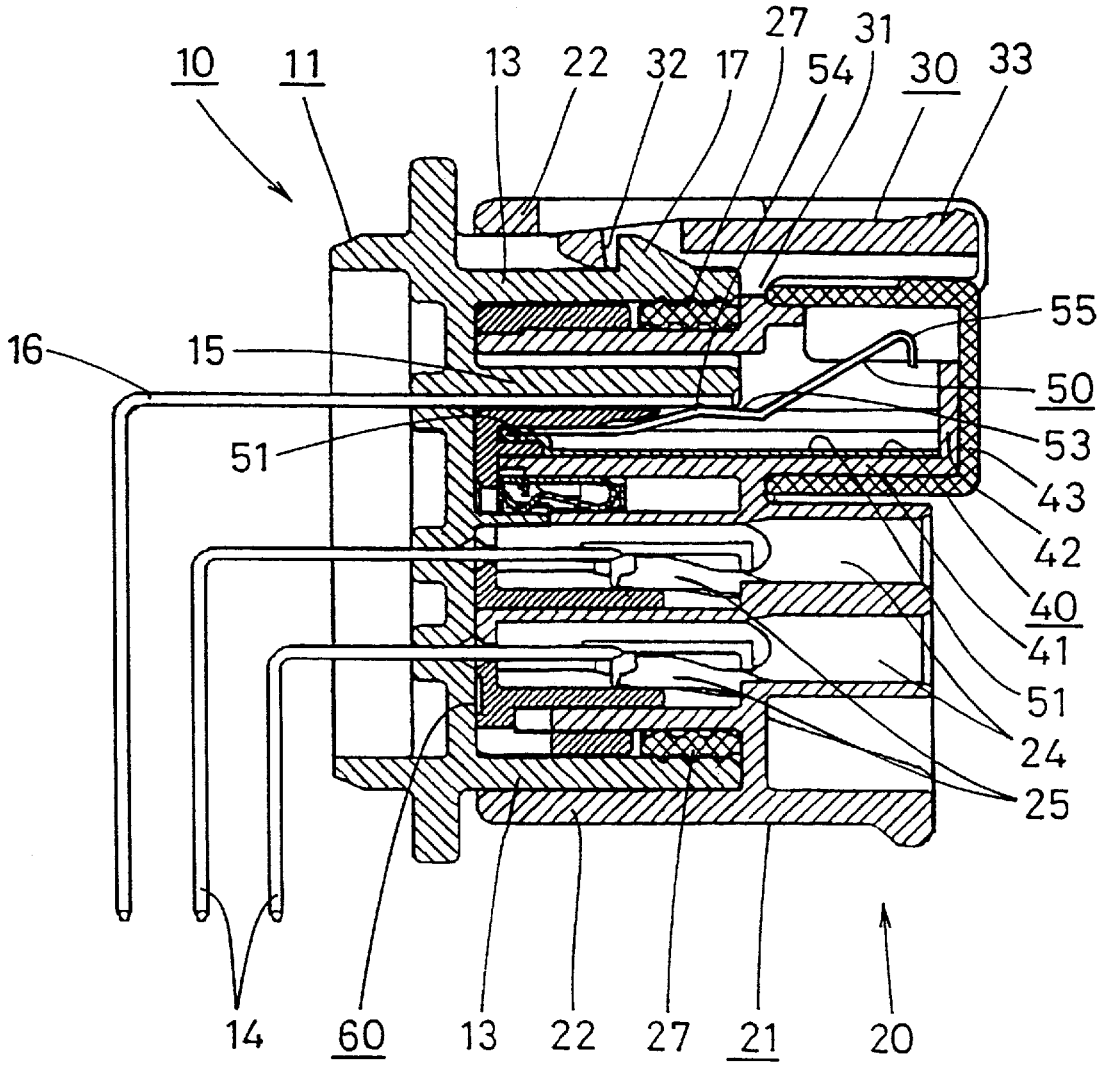
FIG. 5 is a cross-sectional view showing the connectors after fitting has been completed.

As the fitting together of the housings 11 and 21 continues, as shown in FIG. 5, the male terminal fittings 14 are inserted into the corresponding cavities 24 and connect with the female terminal fittings. At the same time, the fitting protrusions 17 of the male housing 11 reach the position of the locking hole 32 of the locking arm 30, the fitting protrusions 17 fitting together with the locking hole 32, and the locking arm 30 returning to its original horizontal position. Thereupon, the pressing force on the pressure receiving members 55 of the short-circuiting terminal 50 is removed, and as a result the sealing cover 43 regains its original shape and the bending member 53 of the short-circuiting terminal 50 moves back upwards. Together with this the connecting members 54 also move upwards, entering into the detecting chamber 40 and making resilient contact with the detecting terminals 16. These two detecting terminals 16 short-circuit and, accordingly, it can be electrically detected by means of an external circuit that the housings 11 and 21 have been correctly fitted together.

In the case that the housings 11 and 21 have not been correctly fitted together, the locking arm 30 remains in a state in which it has risen up over the fitting protrusions 17 and the rear thereof is in a lowered state. Consequently, there is no short-circuit between it and the detecting terminals 16. By this means it can be electrically detected that the housings 11 and 21 are not correctly fitted together.

After the female housing 21 has been fitted to the male housing 11, the anterior of the detecting chamber 40 is covered by the male housing 11. Even though the posterior face of the detecting chamber 40 is covered by the sealing cover 43, this sealing cover 43 is made from soft rubber and there is the danger that it may change shape and come into contact with the short-circuiting terminal 50, and that, in an extreme case, the short-circuiting terminal 50 may change shape beyond its limit of resilience. The rear protective wall 42 which rises upwards from the posterior end of the base face 41 of the detecting chamber 40 guards against this possibility. Consequently, any foreign objects trying to enter axially will strike against the protective wall 42, their entry will be prevented, and they will not come into contact with the short-circuiting terminal 50.

Figure 6:
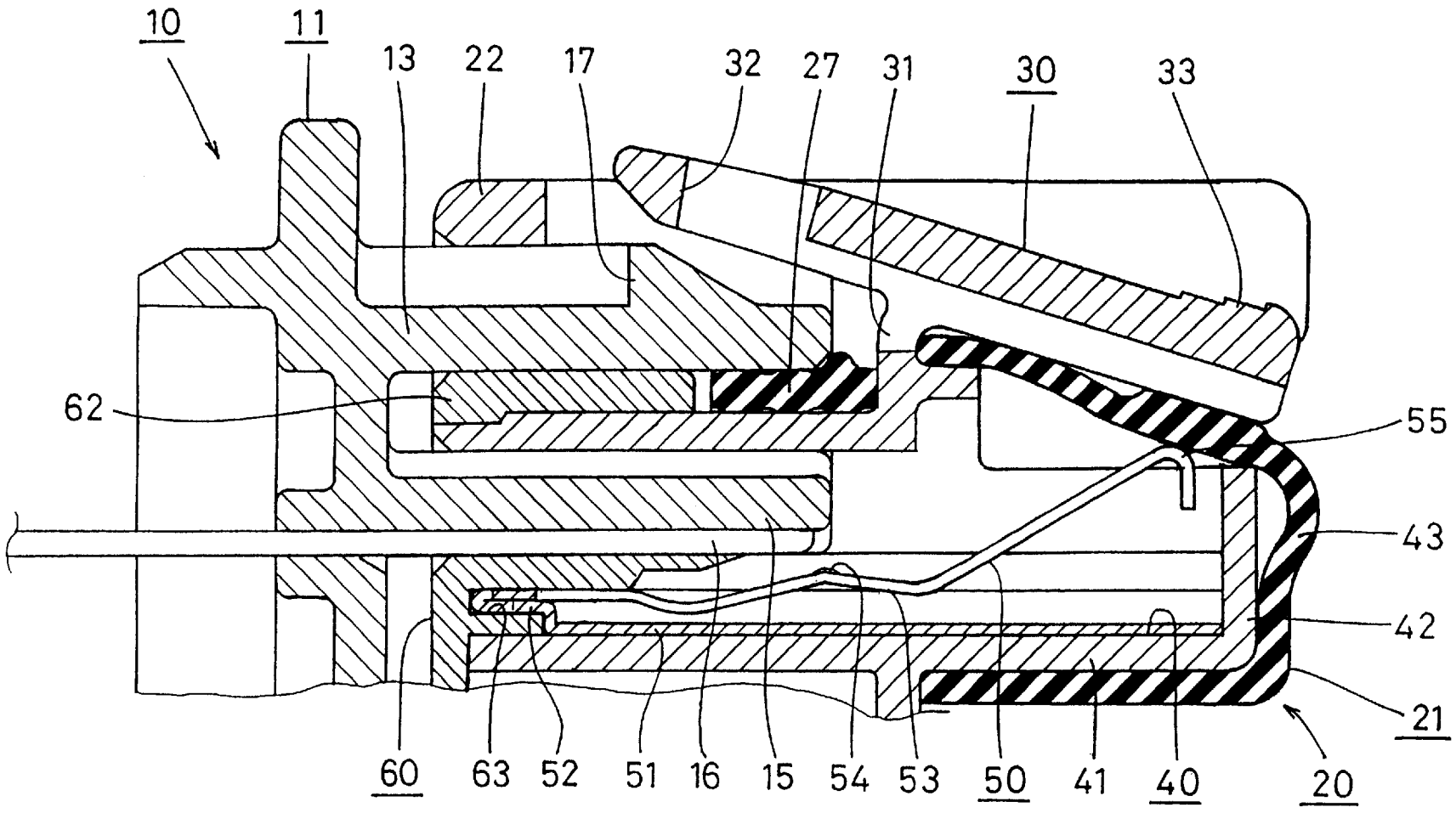
FIG. 6 is a partial cross-sectional view showing the prevention of excessive bending of the short-circuiting terminal resulting from the inclination of a locking arm.
Figure 7:
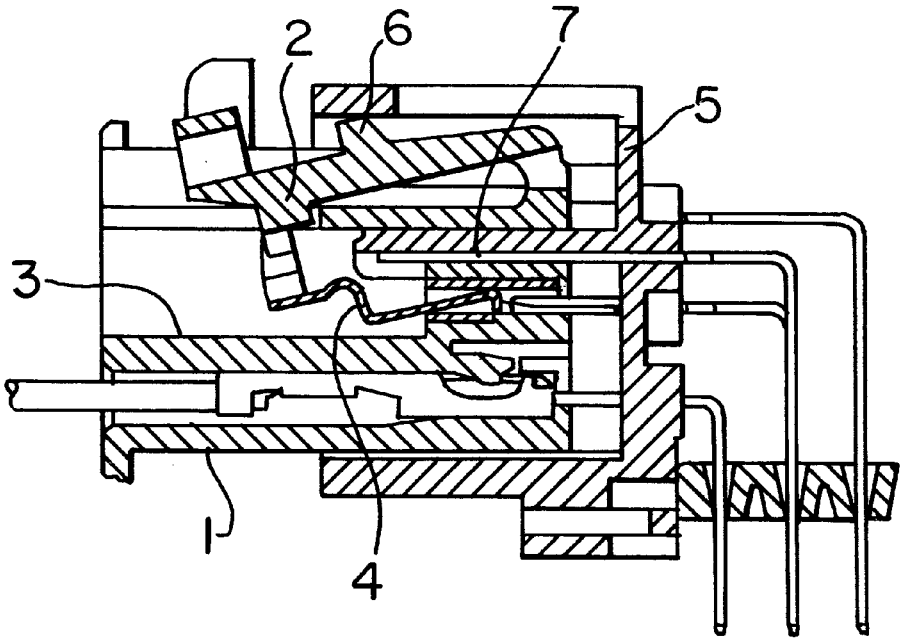
FIG. 7 PRIOR ART
FIG. 7 is a cross-sectional view of a prior art example.

As shown in FIG. 6, if the connectors 10 and 20 are to be separated for maintenance etc., the operating edge 33 is pushed and the locking arm 30 moves in a clockwise direction relative to FIG. 6. As a result the fitting protrusions 17 and the locking hole 32 separate, and then the female housing 21 is pulled away. In the case where the operating edge 33 of the locking arm 30 is pushed downwards, the lower face of the operating edge 33 strikes against the upper edge of the protective wall 42 via the sealing cover 43, thereby regulating the pushing down. Consequently, excessive bending resulting in the short-circuiting terminal 50 changing shape is prevented.

Moreover, the protective wall 42 has been configured such that it stops the short-circuiting terminal 50 in a posterior direction, and also stops the retainer 60 in an anterior direction. The results in an efficient configuration.

The present invention is not limited to the embodiments described above with the aid of figures. For example, the possibilities described below also lie within the technical range of the present invention. In addition, the present invention may be embodied in various other ways without deviating from the scope thereof.

(1) The present invention may equally be used on a configuration in which the posterior face of the detecting chamber 40 is not provided with a sealing cover.

(2) The present invention also applies to a configuration in which the folded member of the shortcircuiting terminal may simply be provided with a protruding portion and nothing more in order to effect the stopping function of the short-circuiting terminal in an anterior direction by the retainer.

What is claimed is:

1. An electrical connector comprising two mutually engageable connector housings, a first of said housings having a chamber containing a resilient short-circuit terminal, and a second of said housings having a detecting terminal engageable with said short-circuit terminal, said first housing further including a latch arm resiliently movable from an engaged to a disengaged condition, and being engageable with a latch member of said second housing, said latch arm and short-circuit terminal being adjacent and movable together such that said short-circuit terminal and detecting terminal are engaged only when said latch arm and latch member are engaged, wherein said chamber has a front opening facing towards said second housing of sufficient size for the entire short-circuit terminal to pass therethrough and into the chamber, and a rear wall at least partially closing the chamber, and wherein said short-circuit terminal is insertable into the chamber through said front opening toward said rear wall of the chamber.

2. A connector according to claim 1, wherein said rear wall acts as an insertion abutment for said short-circuit terminal.

3. A connector according to claim 2 wherein said rear wall is a travel abutment for said latch arm.

4. A connector according to any preceding claim wherein said latch arm and short-circuit terminal are separated by a resilient membrane.

5. A connector according to claim 4 wherein said chamber, further includes a side opening on the side facing said latch arm, said membrane covering said side opening.

6. A connector according to claim 4 wherein said short-circuit terminal is movable by abutment with said latch arm through said membrane.

7. A connector according to claim 5 wherein said short-circuit terminal is movable by abutment with said latch arm through said membrane.

8. A connector according to claim 6 wherein said membrane is attached to said latch arm by adhesive.

9. A connector according to claim 7 wherein said membrane is attached to said latch arm by adhesive.

10. A connector according to claim 1, and further including a retainer attachable over said front opening to retain said short-circuit terminal in said chamber.

11. A connector according to claim 10 wherein said retainer abuts said short-circuit terminal when the latch arm and latch member are engaged.

12. A connector according to claim 1, and further including a retainer attachable over said front opening to retain said short-circuit terminal in said chamber.

* * * * *

UNITED STATES PATENT AND TRADEMARK OFFICE

CERTIFICATE OF CORRECTION

PATENT NO. : 6,257,922 B1
DATED : July 10, 2001
INVENTOR(S) : Tetsuya Shinozaki

It is certified that error appears in the above-identified patent and that said Letters Patent is hereby corrected as shown below:

Column 3,
Line 64, change "being" to -- bending --.

Signed and Sealed this

Fourth Day of June, 2002

*Attest:*

*Attesting Officer*

JAMES E. ROGAN
*Director of the United States Patent and Trademark Office*